United States Patent [19]

Ditton

[11] 4,396,145

[45] Aug. 2, 1983

[54] SELF-LOCKING CARTON

[75] Inventor: Louis G. Ditton, Fort Wayne, Ind.

[73] Assignee: Essex Group, Inc., Fort Wayne, Ind.

[21] Appl. No.: 325,525

[22] Filed: Nov. 27, 1981

[51] Int. Cl.[3] ..... B65D 5/48

[52] U.S. Cl. ..... 229/27; 229/15

[58] Field of Search ..... 229/15, 27, 29 D, 29 E, 229/29 B, 29 C, 28 R, 28 BC

[56] References Cited

U.S. PATENT DOCUMENTS

| | | | |
|---|---|---|---|
| 2,006,725 | 7/1935 | Usinger | 229/27 |
| 2,023,578 | 12/1935 | Daley | 229/27 |
| 2,640,589 | 6/1953 | Foster et al. | 229/15 |
| 3,145,902 | 8/1964 | Nolen | 229/27 |
| 4,347,967 | 9/1982 | Loudermilk, Jr. | 229/27 |

FOREIGN PATENT DOCUMENTS

| | | | |
|---|---|---|---|
| 397047 | 8/1933 | United Kingdom | 229/27 |

*Primary Examiner*—Joseph Man-Fu Moy
*Assistant Examiner*—David T. Fidei
*Attorney, Agent, or Firm*—Stephen A. Schneeberger

[57] ABSTRACT

The invention relates to containers and more specifically to self-locking cartons. More specifically still, the invention relates to compartmented, fully enclosed, self-locking cartons.

9 Claims, 9 Drawing Figures

SELF-LOCKING CARTON

BACKGROUND ART

The structural and design requirements for a container or carton may vary considerably depending upon its contents, usage, environment and other factors. Certain other requirements may be common to most such cartons, as for instance the minimization of manufacturing and assembly costs an the provision of structural integrity. One general class of cartons provides a fully closed container assembled from a single blank. Moreover, that class of cartons may be compartmented or noncompartmented. The present invention is concerned with such fully enclosed, compartmented cartons.

One example of a fully enclosed and compartmented container is disclosed in U.S. Pat. No. 2,743,863 to Glasser in which a compartmented fully enclosed egg case is formed from a single blank. However the compartmenting provided by that integral blank provides limited additional structural integrity, and a separate transverse partition is required. Another type of carton, that disclosed in U.S. Pat. No. 2,830,697 to Paige, achieves both longitudinal and transverse compartmenting using a single blank, however, the top closure is designed and constructed less for protection of the contents than for display purposes. Other patents which disclose fully enclosed and/or compartmented containers include U.S. Pat. Nos. 2,728,449; 2,785,844; 2,880,921; 3,023,945; 3,118,589; 3,208,659; 3,300,116; 3,326,444; 3,456,862; 3,512,695; 3,829,001; 3,836,065; 3,941,302 and 4,019,636.

While these containers fulfill certain requirements, there remains a need to provide a relatively simple, but strong compartmented, fully enclosed container. It is further desirable to provide such a container with the ability to be further subcompartmented with additional discrete compartmenting means.

Accordingly, it is a principal object of the present invention to provide an improved compartmented and fully enclosed carton of relatively simple, unitary construction. Included within this object is the provision of a carton which is particularly resistant to compressive forces. It is an additional object to provide such a carton with discrete additional subcompartmenting means.

In accordance with the present invention, there is provided a fully enclosed, compartmented carton of relatively simple, unitary construction. The carton includes a pair of opposed side walls, a pair of opposed end walls connecting the side walls, a bottom closure, a top closure and compartmenting means for dividing the interior into a plurality of laterally separate compartments. The bottom closure and the top closure are of substantially identical construction and each includes a respective pair of end flaps and a respective pair of side flaps. The end flaps are integrally connected to the respective bottom and top edges of the end walls and foldable respectively upward and downward. Each of the end flaps has at least one longitudinal opening extending from the respective bottom or top edge of the respective end wall only part way to the outer end thereof. Transverse fold lines intersect the respective longitudinal openings in the respective bottom and top end flaps for permitting the portion outwardly thereof to be folded respectively upward and downward. The side flaps are integrally connected to the respective bottom and top edges of the side walls and foldable respectively upward and downward. Each of the side flaps extends more than one-half the width of the carton and has at least one transverse opening extending inward a short distance from the outer end thereof and includes a longitudinal fold line whereby the outer portions of those flaps may be folded respectively upward and downward into the container. The transverse opening in the side flaps are coincident with the respective ones of the fold lines in the respective end flaps and the fold lines in the side flaps are coincident with the respective end flap longitudinal opening such that the outer portions of the side flaps may be folded respectively upward and downward and extend into the container through the respective end flap openings in interlocking relationship therewith. The outer portions of the respective end flaps and the respective side flaps extending upwardly and downwardly into the container provide compartmentation.

In a preferred embodiment, the fold lines in the pairs of top and bottom end flaps and the pairs of top and bottom side flaps are substantially at the longitudinal and transverse medians of the carton respectively such that the flaps of a respective pair are in juxtaposition and the pairs of flaps define four laterally separate contiguous compartments.

The outer portions of both the bottom and the top side flaps extend substantially the full internal height of the carton in juxtaposition with one another to resist vertical compressive forces. Each of the top end flaps includes an access opening through which a finger-like object may be extended to transversely separate the uppermost outer portions of the two juxtaposed bottom side flaps such that the outer portions of both of the top side flaps may be inserted between the separated portions of the bottom side flaps. The outer portions of the pairs of top and bottom end flaps each extend substantially only one-half of the internal height of the compartment in vertical alignment with one another to further resist vertical compressive forces.

Additional compartmentation is provided by separate horizontally oriented panels disposed on the upper ends of the upwardly extending outer portions of the pair of bottom end flaps to further divide the interior of the carton into vertically separate compartments. Vertically oriented support strips are interposed between the panels and both the top closure and the bottom closure for vertically supporting the panels and for further laterally compartmenting the carton.

BEST MODE FOR CARRYING OUT THE INVENTION

Figure 1:
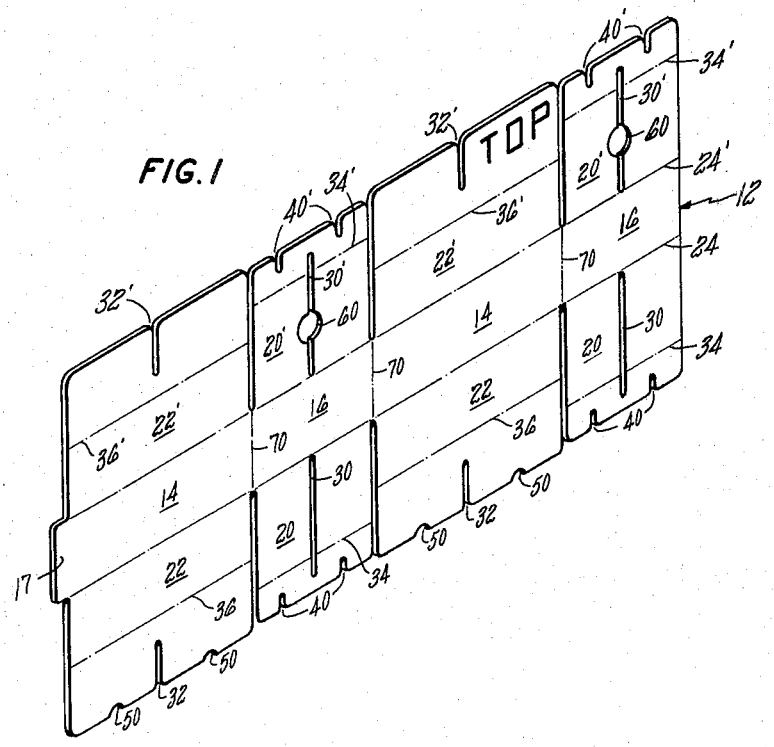
FIG. 1 is a perspective view of a second corrugated paperboard blank.
Figure 2:
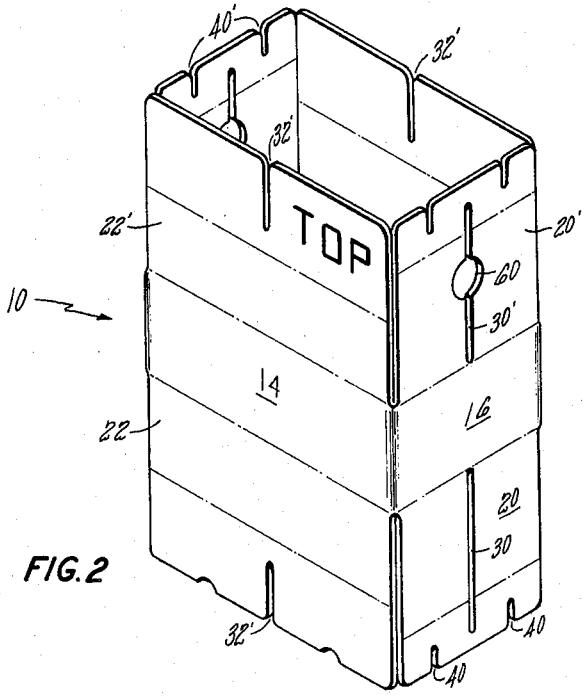
FIGS. 2–5 are successive views of the assembly of the carton, including its bottom closure.
Figure 9:
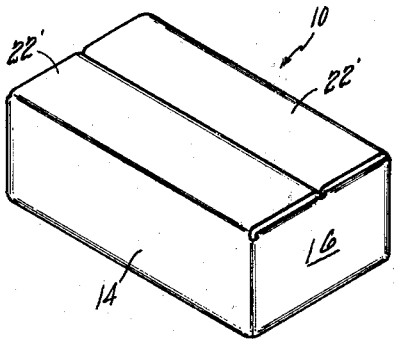

Referring initially to FIGS. 1 and 9, the container or carton 10 of FIG. 9 is assembled entirely or principally from the blank 12 illustrated in FIG. 1. The blank 12 is preferably formed of corrugated paperboard, although other materials such as fiberboard, laminates or other appropriate composition materials may be utilized, depending upon the intended use. In the illustrated example, the container 10 is intended to house a plurality of spools of conductor wire for shipment and/or storage. The blank 12 includes a pair of side walls, each numbered 14 and a pair of end walls, each numbered 16. A small securing tab 17 extends from a side wall 14 at one end of the blank.

With but few exceptions, the top and bottom closures for container 10 of the subject invention are identical, thereby facilitating assembly. Accordingly, in describing the characteristics of the top and bottom closures, those structural features which are identical will be similarly numbered with the exception that the features associated with the top closure will include a primed superscript. The bottom closure of container 10 includes a pair of bottom end flaps 20 and a pair of bottom side flaps 22. The top closure similarly includes a pair of top end flaps 20' and a pair of top side flaps 22' nearly identical with the respective bottom end flaps and side flaps 20, 22.

Each of the adjacent bottom end and side flaps 20, 22 is separated from the next by a narrow slot and is joined to the respective end and side walls 16, 14 along a fold line 24 which defines the hinge line of those flaps with the bottom edges of the respective end and side walls. In the assembled configuration of the carton 10, the end flaps 20 are viewed as extending longitudinally of the carton from the hinge line 24 and the side flaps 22 are viewed as extending transversely or laterally of the carton from the hinge line 24. Accordingly, the following description of the orientations of fold lines and slots in the respective flaps will be referenced to the carton in its assembled form.

Each of the bottom end flaps 20 includes a medial longitudinally extending opening or slot 30 extending from the fold line 24 to near, but not through, the outer end of the flap. Each of the bottom side flaps 22 contains a medial transversely extending opening or slot 32 extending inwardly a short distance from the outer end of the flap. The lengths of both the bottom end flaps 20 and the bottom side flaps 22 from the fold line 24 is more than one-half the dimension of the container in the respective direction in which the flap extends. Further, the bottom end flaps 20 include fold lines 34 and extending transversely the full width of the respective flaps substantially at the midline of that dimension of the carton 10. The outer portion of each of the bottom end walls 20 extends outwardly from the fold line 34 a distance which is approximately one-half the height of the end and side walls 16, 14 of the carton 10. It will be noted that the length of opening 30 extends outwardly at least beyond its point of intersection with fold line 34.

Figure 5:
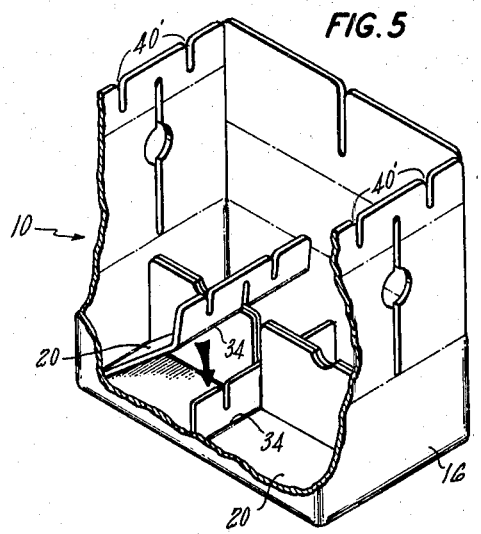
Figure 6:
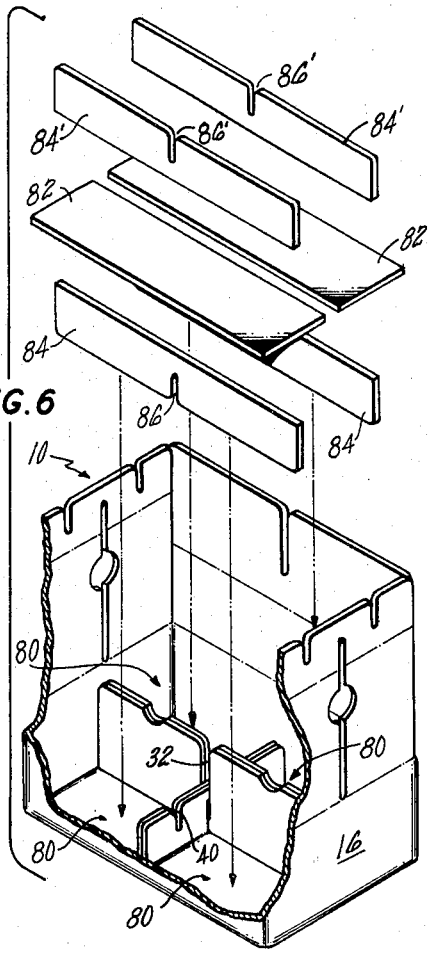
FIG. 6 is a view of the container of FIG. 5, additionally showing in exploded form, optional subcompartmenting panels.

Similarly, each of the bottom side flaps 32 includes a fold line 36 extending longitudinally its full dimension substantially at the midline of that dimension of the carton 10. The outer portion of each of the bottom side flaps 22 extends outwardly from the respective fold lines 36 a distance which is substantially equal to the height of the end and side walls 14, 16. Here it will be noted that the slot 32 in the outer end of each flap extends inwardly less than the full distance to the fold line 36. More particularly, the amount by which slot 30 extends outwardly beyond the fold line 34 in bottom end flap 20 is substantially the same as the distance by which the inner end of slot 32 in bottom side flap 22 is spaced from the fold line 36. Such arrangement will afford the strong, interlocking relationship of the side and end flaps, especially as depicted in FIGS. 5 and 6.

The bottom end flaps 20 may each additionally include a pair of short, subdivider mounting slots 40 positioned on opposite sides of the opening 30 and extending inwardly a short distance from the outer end of the end flap. Typically, the mounting slots 40 will extend about half the distance to the fold line 34.

The bottom side flaps 22 may each also include a pair of optional semiconductor finger notches 50 extending a short distance into the outer end thereof on opposite sides of the slot 32.

Referring to the construction of the top end flaps 20' and the top side flaps 22', it will be noted with reference to FIG. 1 that they are substantially identical to the bottom side and end flaps 20,22 respectively and no further description will be given for those identical characteristics which are identified with primed superscripts. However, it will be observed that neither of the top side flaps 22' possess the finger slots 50 provided in the bottom side flaps. Moreover, a circular access opening 60 is provided in each of the longitudinal slots 30' in the top end flaps 20'. The access openings 60 are of sufficient diameter to permit a human finger, or a finger-like object, to be inserted therethrough for a purpose to be hereinafter described. The access opening 60 is centered on the line 30' and is positioned approximately midway between the upper edge fold line 24' and the fold line 34'.

Referring now to FIGS. 2–9 in succession for the assembly of blank 12 into the finished carton 10, the blank is first bent into rectangular form along respective fold lines 70 between each of the end and side panels 16, 14. The securing flap 17 is overlapped with the opposite end of the blank 12 and secured thereto by suitable means, such as stapling or gluing, to provide the initial form of carton 10 illustrated in FIG. 2.

Figure 3:
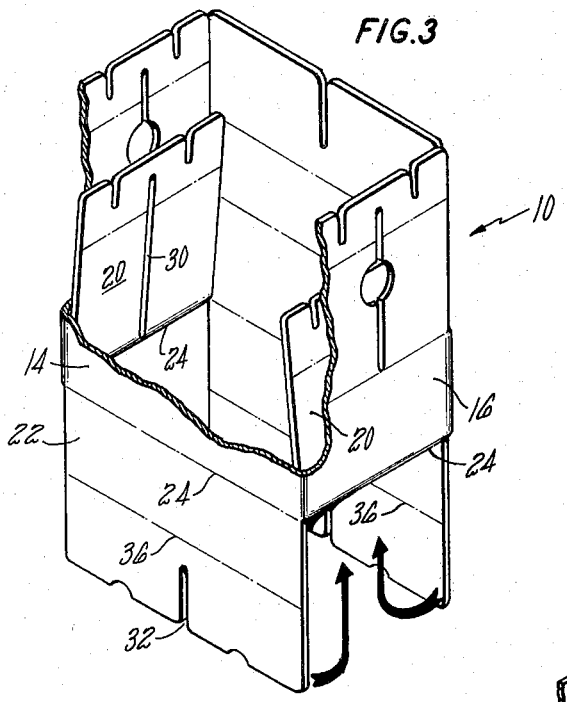
Figure 4:
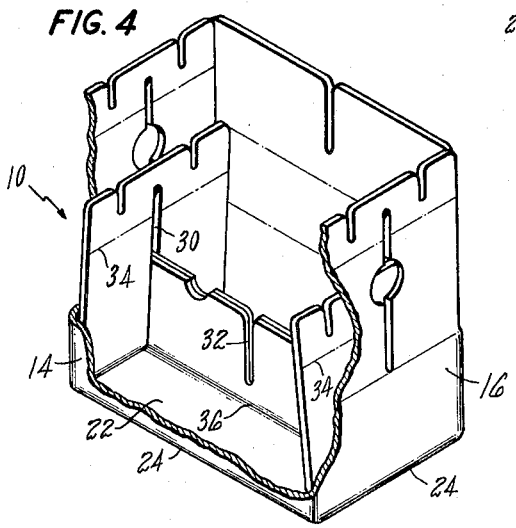

Referring to FIG. 3, the bottom end flaps 20 are bent upwardly along fold line 24 such that they temporarily extend upwardly into carton 10. The bottom side flaps 22 are then creased along fold line 24 such that they may be folded inwardly at a 90° angle thereat to form the bottom closure of the carton. Additionally, as illustrated in FIGS. 3 and 4, the outer portions of the bottom side flaps 22 are bent upwardly along fold lines 36 so as to extend upwardly into the carton 10 in juxtaposition with one another. The medial positioning of bottom end flap slots 30 enables the outer portions of the bottom side flaps 22 to extend upwardly therethrough when the end flaps 20 are pushed downwardly thereover as illustrated in FIG. 5. The outer portions of the respective bottom end flaps 20 are bent upwardly along fold line 34 and extend upwardly into carton 10 in juxtaposition with one another. Those outer portions of the bottom end flaps 20 are received in the now-vertically extending slot 32 in the upwardly extending outer portion of bottom side flaps 22.

Referring to FIG. 6, it will be observed that the vertically extending outer portions of bottom side flaps 22 extend substantially the same height as the end and side walls 14, 16, and that the upwardly extending outer portions of the bottom end flaps 20 extend about half the height of those side walls. Thus it will be seen that these upwardly extending portions of the bottom side and end flaps create four laterally adjacent compartments 80.

It may be desirable to further subcompartment the container, both in the lateral and in the vertical directions. Accordingly, there may be provided optional subcompartments means including a pair of horizontally disposed rectangular panels 82, a pair of lower vertically oriented strips 84 and a pair of upper vertically oriented strips 84'. The strips 84 and 84' and the panels 82 each extend longitudinally of the carton. The strips 84, 84' each include a respective medially positioned slot 86, 86' extending respectively upward or downward from the respective lower or upper edge. The slots 86 of strips 84 may then be interfitted with the respective slots 40 in the upwardly extending outer portions of bottom end flaps 20 such that strips 84 further laterally subdivide carton 10. Panels 82 may then be rested upon the upper edges of strips 84 on either side of the longitudinal divider or the carton to subdivide the carton into upper and lower halves. The upper strips 84' may be interfitted with the compartmenting structure in the top closure in the same manner as described for the bottom closure thereby to further laterally subdivide the upper half of the carton.

Figure 7:
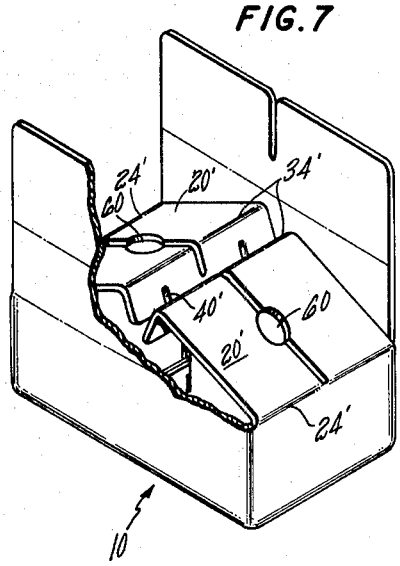
FIGS. 7–9 successively illustrate completion of the assembly of the carton, including its top closure.

Referring to FIG. 7, the carton 10 is illustrated with the top end flaps 20' of the top closure folded inwardly along fold line 24' and the outer portions thereof folded downwardly along the fold lines 34'. Those downwardly extending outer portions of the top end flaps 20' are received in the upper portion of the slot 32 in the longitudinally extending divider formed by the outer ends of the bottom side walls 22 (seen in FIG. 6). The slots 40' in upper end flaps 20° also coincide with the slots 86' in the upper ends of strips 84' in the manner previously described for the bottom closure.

Figure 8:
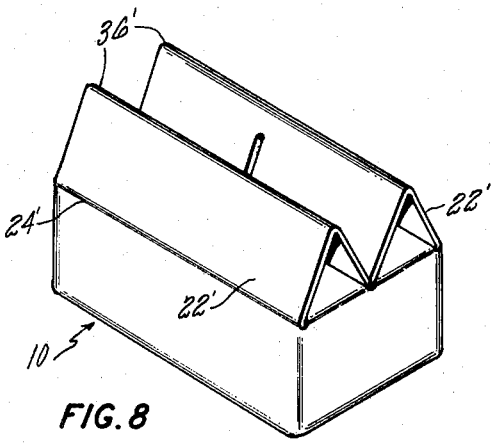

Referring to FIGS. 7–9, a finger or a finger-like object is then inserted through each of the access openings 60 to engage and laterally separate the juxtaposed upwardly extending bottom side flaps 22. The top side flaps 22' are then bent inwardly along fold line 24' and the outer portions thereof are bent downwardly along fold lines 36' and are inserted into the narrow space created by the separation between the upwardly extending bottom side flaps 22. In this manner the upwardly extending portions of the bottom side flaps 22 securely embrace the downwardly extending portions of the top side flaps 22' to aid in maintaining the carton 10 closed. These downwardly extending outer portions of the top side flaps additionally serve to strengthen the carton 10 against vertical compressive loading. Thus the container construction of the present invention provides a fully closed carton 10 which is compartmented, durable and of relatively simple construction.

Although this invention has been shown and described with respect to detailed embodiments thereof, it will be understood by those skilled in the art that various changes in form and detail thereof may be made without departing from the spirit and scope of the claimed invention.

I claim:

1. A compartmented carton comprising a pair of opposed side walls, a pair of opposed end walls connecting the side walls, a bottom closure, a top closure and compartmenting means for dividing the interior of the carton into a plurality of laterally separate compartments, said bottom closure comprising bottom end flaps integrally connected to the bottom edges of said end walls and foldable upward, each of said bottom end flaps having at least one longitudinal opening extending from the bottom edge of the respective end wall only part way to the outer end thereof, said bottom end flaps having transverse fold lines intersecting the respective longitudinal openings therein for permitting the portion outwardly thereof to be folded upwardly, the bottom side flaps integrally connected to the bottom edges of said side walls and foldable upward, each of said bottom side flaps extending more than one-half the width of the carton and having at least one transverse opening extending inward a short distance from the outer end thereof and having a longitudinal fold line whereby the outer portions of said bottom side flaps may be folded upwardly into the container, the transverse openings in said bottom side flaps being coincident with the respective ones of the fold line in said bottom end flaps and the fold lines in said bottom side flaps being coincident with respective said bottom end flap longitudinal openings such that the outer portions of said bottom side flaps may be folded upwardly and extended into the container through said bottom end flap openings in interlocking relation therewith, said top closure comprising to end flaps integrally connected to the top edges of said end walls and foldable downward, each of said top end flaps having at least one longitudinal opening extending from the top edge of the respective end wall only part way to the outer end thereof, transverse fold lines intersecting the respective longitudinal openings therein for permitting the portion outwardly thereof to be folded downwardly, and top side flaps integrally connected to the top edges of said side walls and foldable downward, each of said top side flaps extending more than one-half the width of the carton and having at least one transverse opening extending inward a short distance from the outer end thereof and having a longitudinal fold line whereby the outer portion of said top side flaps may be folded downwardly into the container, the transverse openings in said top side flaps being coincident with the respective ones of the fold lines in said top end flaps and the fold lines in said top side flaps being coincident with respective said top end flap longitudinal openings such that the outer portions of said top side flaps may be folded downwardly and extended into the container through said top end flap openings in interlocking relation therewith, said compartmenting means including said outer portions of said bottom end and side flaps and said outer portions of said top end and side flaps extending respectively upward and downward into the container.

2. The carton of claim 1 wherein the longitudinal folds in said top and said bottom side flaps are substantially at the transverse median of the carton such that the upwardly extending outer portions of the bottom side flaps are substantially in juxtaposition with one another and the downwardly extending outer portions of the top side flaps are substantially in juxtaposition with one another.

3. The carton of claim 2 wherein said top and said bottom end flaps each extend more than one-half the length of the carton and the transverse folds therein are substantially at the longitudinal median of the carton such that the upwardly extending outer portions of the bottom end flaps are substantially in juxtaposition with one another and the downwardly extending outer portions of the top end flaps are substantially in juxtaposition with one another thereby to define four laterally separate contiguous compartments.

4. The carton of claim 1 wherein the outer portions of at least one pair of said pairs of bottom end flaps, bottom side flaps, top end flaps and top side flaps extends substantially the full internal height of the carton thereby to resist vertical compressive forces.

5. The carton of claim 4 wherein the outer portions of both said bottom and said top side flaps extend substantially the full internal height of the carton in mutual juxtaposition.

6. The carton of claim 5 wherein each of said top end flaps includes an access opening through which a finger-like object may be extended to transversely separate the uppermost outer portions of the two juxtaposed bottom side flaps, said outer portions of both said top side flaps being downwardly inserted between said separated portions of said bottom side flaps.

7. The carton of claim 4 wherein said outer portions of said pair of top and said pair of bottom end flaps each extend about one-half of the full internal height of the carton in vertical alignment with one another thereby to further resist vertical compressive forces.

8. The carton of claim 1 wherein said outer portions of said pair of top and said pair of bottom end flaps each extend substantially only one-half of the full internal height of the carton, and wherein said compartmenting means includes separate horizontally-oriented panel means disposed on the upper ends of the upwardly extending outer portions of said pair of bottom end flaps to further divide the interior of the carton into vertically separate compartments.

9. The carton of claim 8 wherein said compartmenting means further includes vertically oriented support strip means interposed between said panel means and both said top closure and said bottom closure for vertically supporting said panel means and for further laterally compartmenting said carton.

* * * * *